US009915507B1

(12) United States Patent
Cummins

(10) Patent No.: US 9,915,507 B1
(45) Date of Patent: Mar. 13, 2018

(54) DURABLE TARGET

(71) Applicant: Timothy Wayne Cummins, Portland, TN (US)

(72) Inventor: Timothy Wayne Cummins, Portland, TN (US)

( * ) Notice: Subject to any disclaimer, the term of this patent is extended or adjusted under 35 U.S.C. 154(b) by 0 days.

(21) Appl. No.: 15/792,583

(22) Filed: Oct. 24, 2017

Related U.S. Application Data

(63) Continuation-in-part of application No. 15/069,664, filed on Mar. 14, 2016, now Pat. No. 9,797,694.

(60) Provisional application No. 62/132,448, filed on Mar. 12, 2015.

(51) Int. Cl.
*F41J 1/10* (2006.01)

(52) U.S. Cl.
CPC ..... *F41J 1/10* (2013.01)

(58) Field of Classification Search
CPC ..... F41J 1/10; F41J 9/02; F41J 7/04; A63B 63/06
USPC ..... 273/390–392, 403–408, 359; 446/237, 446/269, 273, 274, 279, 280, 287, 288
See application file for complete search history.

(56) References Cited

U.S. PATENT DOCUMENTS 3,866,652 A * 2/1975 Ahmad ..... B60O 7/105 152/310
3,917,270 A * 11/1975 Gothard, Jr. ..... F41J 9/02 273/359
4,155,554 A * 5/1979 Adamski ..... B60P 1/28 102/362
4,266,780 A * 5/1981 McQuary ..... F41J 3/0076 235/121
4,285,854 A * 8/1981 Kageyama ..... B29D 30/04 524/789
5,405,673 A * 4/1995 Seibert ..... F41H 5/02 273/317
5,433,451 A * 7/1995 De Vries ..... F41J 7/04 273/392
5,486,425 A * 1/1996 Seibert ..... F41H 5/02 273/348
5,676,378 A * 10/1997 West ..... F41J 1/10 273/390
5,775,698 A * 7/1998 Jones ..... F41J 9/02 273/359
5,816,579 A * 10/1998 Broussard ..... F41J 1/01 273/407
5,967,523 A * 10/1999 Brownlee ..... F41J 1/10 273/407
6,435,512 B1 * 8/2002 Beckwith, Sr. ..... F41J 1/10 273/403
7,066,724 B2 * 6/2006 Danules ..... B29C 44/02 222/214
7,694,973 B1 * 4/2010 Hofmeister ..... F41J 7/06 273/391

(Continued)

*Primary Examiner* — Mark Graham
(74) *Attorney, Agent, or Firm* — Shane V. Cortesi

(57) ABSTRACT

Long-lasting targets that can be repeatedly used (e.g., shot with a firearm) are disclosed. In some embodiments, the target includes a base that optionally has wheels, at least one post assembly comprising a bottom end connected to the base and a top end, and a target body connected to the at least one post assembly. Optionally, the target body is comprised of a polyurethane. Optionally, the target includes two post assemblies and the target has an expanded position for use and a collapsed position for storage. Methods of preparing targets using a mold are also described herein.

16 Claims, 13 Drawing Sheets

(56) References Cited

U.S. PATENT DOCUMENTS

| | | | | |
|---|---|---|---|---|
| 7,900,927 | B1 * | 3/2011 | Bliehall | F41J 9/02 273/359 |
| 7,984,910 | B1 * | 7/2011 | Nielsen | A63B 63/00 273/359 |
| 8,322,249 | B2 * | 12/2012 | Seavey | B25J 5/005 74/490.01 |
| 8,712,602 | B1 * | 4/2014 | Oliver | F41H 7/005 701/1 |
| 8,757,626 | B2 * | 6/2014 | Acker | F41J 1/01 273/403 |
| 9,797,694 | B1 * | 10/2017 | Cummins | F41J 1/10 |
| 2010/0032906 | A1 * | 2/2010 | Wilcox | F41J 7/04 273/391 |
| 2011/0089639 | A1 * | 4/2011 | Bellamy | F41J 9/02 273/359 |
| 2011/0175294 | A1 * | 7/2011 | Amodt | F41J 1/10 273/407 |
| 2012/0208150 | A1 * | 8/2012 | Spychaiski | F41H 7/005 434/20 |
| 2013/0341869 | A1 * | 12/2013 | Lenoff | F41J 9/02 273/406 |
| 2014/0008870 | A1 * | 1/2014 | Jensen | F41J 1/01 273/348 |
| 2015/0102563 | A1 * | 4/2015 | Gwash | F41J 7/06 273/390 |
| 2015/0184984 | A1 * | 7/2015 | Johnson | F41J 1/10 273/359 |
| 2015/0330747 | A1 * | 11/2015 | Ferrell | F41J 1/10 273/407 |
| 2016/0018198 | A1 * | 1/2016 | Pettey | F41J 9/02 273/406 |

* cited by examiner

DURABLE TARGET

RELATED APPLICATIONS

This application is a continuation-in-part of U.S. patent application Ser. No. 15/069,664, filed Mar. 14, 2016, which claims priority under 35 USC 119 to U.S. Patent Provisional Application No. 62/132,448, filed Mar. 12, 2015, the contents of each of which are incorporated herein by reference in their entirety.

BACKGROUND

Technical Field

The present invention relates to targets, more particularly, to targets that can be repeatedly used without wearing out.

Background of the Invention

A familiar target at shooting ranges is a piece of paper with a bulls eye that is mounted to a pulley system that allows the marksman to pull the paper target in after he/she is finished to review his/her performance.

U.S. Pat. No. 8,757,626 (the '626 patent) teaches a target that is made of a 1) a target body in the form of a foam block; 2) a single "self-sealing layer" covering the front face of the target body; and 3) a single fabric layer covering the single self-sealing layer. According to the '626 patent, when the an arrow passes through the fabric layer and the self-sealing layer, the self-sealing layer self seals as the arrow becomes embedded in the target body. An image is provided on the fabric layer of the target preferably by a dye sublimation process. According to the '626 patent, the combination of the self-sealing material and the manner in which the image is applied to the target material permits repeated use of the target. The self-sealing material is preferably small cell, cellular plastic or rubber, such as open cell styrene butadiene rubber (SBR) or open cell styrene. Unfortunately, because the arrows become embedded in the target body, they must be removed when the target body becomes filled with arrows, which could damage the target body.

U.S. Patent Publication No. 2014/0008870 (the '870 publication) teaches a bulls eye acoustic target that includes an insulating body member made of a particular type of polystyrene (namely, extruded polystyrene foam having a density in the range of 20-70 kg/m3, preferably, 28-38 kg/m3) covered by a thermoplastic polymer such as polypropylene. According to the '870 publication, the target does not crumble when in use and the insulating body member is made of a material that is capable of allowing the projectile to penetrate the insulating body member and keeping that portion of the insulating body member that has been in contact with the penetrating projectile mechanically connected to the remaining portion of the insulating body member.

While, such bulls eye targets are widely used, it is desirable to create targets that mimic live animals to create a more realistic experience. Most interactive targets that offer realism, however, do not offer durability and would fail after a very short period of use. By design, rounds that are discharged from firearms are destructive by nature. Accordingly, targets made of wood, paper, foam, and most plastics degenerate quickly when being repeatedly fired at in training and recreational shooting.

U.S. Pat. No. 5,486,425 (the '425 patent) describes a self-sealing target that includes a body of an ionomeric polymer such as a co-polymer of ethylene and a vinyl monomer having an acidic group. An example of such a polymer is SURLYN (Dupont Corporation, Wilmington Del.). According to the '425 patent, SURLYN has a normal density of 0.95 g/cm$^3$ and a Shore D hardness of 65. As described in the '425 patent, the ionomeric material may also be vacuum formed into a three dimensional structure of a particular desired shape and size such as a humanoid for use in military and training application. The '425 patent, however, does not describe the durability of the targets in detail, and further does not provide a detailed explanation on whether the targets offer a realistic targeting experience, other than its shape.

Thus, there is a continuing need in the art for targets that are durable and mimic the body of an animal.

BRIEF SUMMARY

The present disclosure provides a target. In some embodiments, the target includes: a) a base comprising a bottom surface configured to face the ground, a top surface opposite the bottom surface, a forward end, a rear end, a base length extending from the forward end to the rear end, a left side, a right side, and a base width extending from the left side to the right side; b) at least one post assembly comprising a bottom end connected to the base, a top end and a height extending from the bottom end to the top end; and c) a target body comprised of a polyurethane and connected to the at least one post assembly (more preferably the top end of the at least one post assembly), the target body having a bottom end, a top end, a height extending from the bottom end to the top end, a front end, a rear end, a thickness extending from the front end to the rear end, a left side, a right side, and a width extending from the left side to the right side.

Optionally, the polyurethane comprises at least about 75% by weight of the target body. Optionally, the target body has a durometer (Shore A) of from about 5 to about 45 (more preferably from about 5 to about 40, even more preferably from about 5 to about 35). Optionally, the target further comprises at least one wheel (preferably three wheels) attached to the base and configured to move the base along the ground. Optionally, the at least one wheel is a caster wheel. Optionally, the base comprises two wheels located adjacent to an end of the base and a caster wheel adjacent to an opposite end of the base. Optionally, the base comprises two wheels located approximately in the center of the base, a front caster wheel adjacent to the front end of the base, and a rear caster wheel adjacent to the rear end of the base. Optionally, the base further comprises a motor configured to move the at least one wheel and a power source configured to power the motor. Optionally, the at least one post assembly is generally cylindrical. Optionally, the target comprises two post assemblies, each post assembly comprising a bottom end connected to the base, a top end and a height extending from the bottom end to the top end. Optionally, each post assembly extends between about 50% and about the 125% of the height of the target body (more preferably between about 50% and about 100% of the height of the target body, even more preferably between about 50 and about 90% of the height of the target body). Optionally, each post assembly is located approximately in the middle of the target body thickness. Optionally, the post assemblies are generally the same height. Optionally, the target has a height extending from the base to the top of the target body of from about 3 feet to about 8 feet. Optionally, the target body has a median thickness of from about 8 inches to about 24 inches and a median width of from about 12 inches to about 36 inches. Optionally, the target body is generally in the shape of a body of an animal. Optionally, the at least one post assembly comprises a bottom post connected to the base and a top post connected to the target body and further wherein the bottom post comprises a hollow interior and the top post is configured to partially nest in the bottom post interior and move relative to the bottom post. Optionally, moving the top post relative to the bottom post is configured to change the height of the target. Optionally, the target further comprises a motor configured to move the top post relative to the bottom post and a power source configured to power the motor. Optionally, the target further comprises a left flange extending generally upwardly from the base left side, a right flange extending generally upwardly from the base right side, an aperture located in each flange, a hollow horizontal bar generally parallel to the target width and traversing the base, and a pin configured to be removably inserted through the flange apertures and through the hollow horizontal bar. Optionally, the target comprises an expanded position in which the pin is inserted through the flange apertures and through the hollow horizontal bar and in which the at least one post assembly is generally perpendicular to the base and further wherein the target comprises a collapsed position in which the pin is removed from the hollow horizontal bar and in which the at least one post assembly is at an angle of between about 0 degrees and about 45 degrees relative to the base. Optionally, the target further comprises a spring having a forward end connected to the at least one post assembly and a rear end connected to the base. Optionally, the base is generally rectangular in shape. Optionally, the target body glows green when irradiated with only black light. Optionally, the target body glows blue when irradiated with black light and white light. Optionally, the target is used in a method that includes: a) providing the target; and b) aiming a fighting implement towards the target. Optionally, the fighting implement is metallic. Optionally, the fighting implement is selected from the group consisting of a sword, a bow, and a bullet. Optionally, the method further comprises irradiating the target body with black light.

In some embodiments, the target includes: a) a base comprising a bottom surface configured to face the ground, a top surface opposite the bottom surface, a forward end, a rear end, a base length extending from the forward end to the rear end, a left side, a right side, and a base width extending from the left side to the right side; b) a left post assembly and a right post assembly, each post assembly generally cylindrical in shape and comprising a bottom end connected to the base, a top end and a height extending from the bottom end to the top end; and c) a target body connected to the left post assembly and the right post assembly, the target body having a bottom end, a top end, a height extending from the bottom end to the top end, a front end, a rear end, a thickness extending from the front end to the rear end, a left side, a right side, and a width extending from the left side to the right side. The target may include one or more of the components described above including without limitation the characteristics of the target body described above, and the wheel, the motor, the post assemblies, the flanges, the pin and the horizontal bar described above.

In still further embodiments, the target includes: a) a base comprising a bottom surface configured to face the ground, a top surface opposite the bottom surface, a forward end, a rear end, a base length extending from the forward end to the rear end, a left side, a right side, and a base width extending from the left side to the right side, at least one wheel attached to the base and configured to move the base along the ground, and a first motor configured to move the at least one wheel and a first power source configured to power the first motor; b) at least one post assembly comprising a bottom end connected to the base, a top end and a height extending from the bottom end to the top end; and c) a target body comprised of a polyurethane and connected to the at least one post assembly, the target body having a bottom end, a top end, a height extending from the bottom end to the top end, a front end, a rear end, a thickness extending from the front end to the rear end, a left side, a right side, and a width extending from the left side to the right side.

The target may include one or more of the components described above including without limitation the characteristics of the target body described above, and the post assemblies, the flanges, the pin and the horizontal bar described above. Optionally, the base further comprises a base microprocessor configured to control the first motor and a receiver in electronic communication with the remote control microprocessor and the system further comprises a remote control comprising a remote control microprocessor configured to control the base microprocessor and the first motor, a transmitter configured to transmit control signals from the remote control microprocessor to the receiver and a second power source configured to power the remote control microprocessor. Optionally, the target comprises a bottom post connected to the base and a top post connected to the target body, wherein the bottom post comprises a hollow interior and the top post is configured to partially nest in the bottom post interior and move relative to the bottom post, wherein moving the top post relative to the bottom post is configured to change the height of the target, and wherein the target further comprises a second motor configured to move the top post relative to the bottom post and a third power source configured to power the second motor, and further wherein the remote control microprocessor is configured to control the second motor.

Optionally, the target is prepared by a method that includes: a) providing a mold in the shape of a body of an animal; b) mixing a polyol, a diisocyanate and a catalyst to form a mixture in the mold; and c) allowing the mixture to form a polyurethane in the shape of a body of an animal. Optionally, the method further includes the step of heating the mixture after step b). Optionally, the polyurethane in the shape of a body of an animal has a durometer shore A of from about 5 to about 45. Optionally, the diisocyanate is tolylene diisocyanate. Optionally, the mold comprises a top end, a bottom end comprising at least one aperture, a height extending from the top end to the bottom end, a front end, a rear end, a thickness extending from the front end to the rear end, a left side, a right side, and a width extending from the left side to the right side, and further wherein the method further comprises inserting a post assembly through the at least one aperture prior to or during step c). Optionally, the post assembly is generally cylindrical in shape. Optionally, the post assembly is inserted through the at least one aperture so that the post assembly extends between about 50% and about 125% of the height of the mold (more preferably between about 50% and about 100% of the height of the mold, even more preferably between about 50 and about 90% of the height of the target body). Optionally, the bottom end comprises two apertures and the method further comprises providing two post assemblies and inserting a post assembly through each aperture prior to or during step c). Optionally, the mold is generally hollow prior to step b). Optionally, the rear side is generally open prior to step b).

In some embodiments, the polyurethane of the target body allows bullets to pass through and self-heals. The target body may be used in a combination with a variety of different caliber bullets and from a variety of different distances.

In still further embodiments, the target includes: a) a base comprising a bottom surface configured to face the ground, a top surface opposite the bottom surface, a base height extending from the bottom surface to the top surface, a forward end, a rear end, a base length extending from the forward end to the rear end and generally perpendicular to the base height, a left side, a right side, and a base width extending from the left side to the right side and generally perpendicular to the base height and base length; b) at least one wheel extending downwardly from the base and configured to move the base along the ground; c) a rotatable swivel connected to the base and located above the base, the rotatable swivel configured to rotate about a swivel axis generally parallel to the base height; d) a front plate and a rear plate opposite the front plate, the front and rear plates connected to the rotatable swivel and located above the swivel, the front and rear plates separated by a generally arc-shaped slot, the front plate and the rear plate having a height generally parallel to the base height; e) a post assembly comprising a post assembly bottom seated inside the slot and connected to the rotatable swivel, a post assembly top and a post assembly height extending from the post assembly bottom to the post assembly top; and f) a target body connected to the post assembly, the target body having a bottom end, a top end, a height extending from the bottom end to the top end, a front end, a target body height extending from the top end to the bottom end, a rear end, a thickness extending from the front end to the rear end, a left side, a right side, and a width extending from the left side to the right side, wherein the at least one post assembly extends at least partially through the target body. Optionally, the post assembly is configured to tilt along an arc (in a plane generally parallel to the front plate and rear plate) within the slot from an upright position in which the post assembly height and the target body height are generally parallel to the base height to an tilted position in which the target body moves downwardly toward the ground and in which the post assembly height and the target body height are at least angled about 10 degrees relative to the base height and the front plate height. Optionally the target body and the post assembly are configured to rotate with the rotatable swivel about the swivel axis of rotation. Optionally, the front plate and the rear plate each comprise at least one aligned fastener hole and the post assembly comprises a first fastener hole and a second fastener hole, and further wherein inserting a fastener through the front plate and rear plate fastener holes and the first fastener hole of the post assembly is configured to secure the post assembly in the upright position and further wherein inserting a fastener through the front plate and rear plate fastener holes and the second fastener hole of the post assembly is configured to secure the post assembly in the tilted position. Optionally, the front plate and the rear plate each comprise a top fastener hole and a bottom fastener hole, wherein the top fastener hole of the front plate is aligned with the top fastener hole of the rear plate, wherein the bottom fastener hole of the front plate is aligned with the bottom fastener hole of the rear plate, wherein the post assembly comprises a bottom fastener hole aligned with the front plate and rear plate fastener holes, wherein a bottom fastener extends through the front plate bottom fastener hole, the post assembly bottom fastener hole and then through the rear plate bottom fastener hole when the post assembly is in the upright position and the tilted position, wherein the post assembly comprises a top fastener hole that is located directly above the post assembly bottom fastener hole when the post assembly is in the upright position, wherein the post assembly further comprises at least one intermediate fastener hole located laterally to the top fastener hole and below the top fastener hole when the post assembly is in the upright position, wherein a top fastener removably extends through the front plate top fastener hole, the post assembly top fastener hole and then through the rear plate top fastener hole when the post assembly is in the upright position, and further wherein the top fastener extends through the front plate top fastener hole, the post assembly intermediate fastener hole and then the through the rear plate top fastener hole when the post assembly is in the tilted position. Optionally, the top fastener is in the form of a removable pin. Optionally, the top fastener and the bottom aperture extend through the front plate, the post assembly and the rear plate generally perpendicular to the swivel axis of rotation. Optionally, the post assembly comprises left and right bottom posts, the left and right bottom posts having a left and right bottom post height extending generally parallel to the target body height, wherein the post assembly further comprises a lower horizontal post extending generally perpendicular to the post assembly height from the left post to the right post and comprising the bottom post assembly fastener hole, and further wherein the post assembly further comprises an upper horizontal post extending generally perpendicular to the post assembly height from the left post to the right post, above the lower horizontal post and comprising the top post assembly apertures. Optionally, the post assembly further comprises a left top post having a lower portion connected to the left bottom post and an upper portion connected to the target body and further wherein the post assembly further comprises a right top post having a lower portion connected to the right bottom post and an upper portion connected to the target body, the left top post and the right top post generally parallel to the target body height. Optionally, the swivel is configured to rotate 360 degrees about the swivel axis. Optionally, the swivel is comprised of a bushing and a top plate located above the bushing and connected to and located below the front and rear plates, and further wherein the target comprises a stand connected to the base and further comprising a bottom plate, and further wherein the bushing separates the top plate from the bottom plate and allows for rotation of the top plate relative to the bottom plate around the swivel axis. Optionally, the target further includes a spindle connecting the top plate to the bushing and to the bottom plate. Optionally, in the upright position and the tilted position, the target body is located above the base.

In still further embodiments, the present disclosure provides a method of using a target comprising the steps of; a) providing the target; and b) aiming a fighting implement towards the target. Optionally, the fighting implement is metallic. Optionally, the fighting implement is selected from the group consisting of a sword, a bow, and a bullet.

BRIEF DESCRIPTION OF THE DRAWINGS

in FIG. 1, the target is in the expanded position.

in FIG. 2, the target is in the expanded position.

in FIG. 3, the target is in the expanded position.

in FIG. 4, the target is in the collapsed position.

in FIG. 5, the target is in the collapsed position and the pin has been re-inserted through the flange apertures.

in FIG. 8, the post assembly is in the upright position.

in FIG. 9, the post assembly is in the tilted position.

in FIG. 10, the post assembly is in the tilted position.

in FIG. 11, only a portion of the post assembly is shown however it will be understood that the entire post assembly height follows the left post bottom and right post bottom due to the connection of the left post top to the left post bottom and the right post top to the right post bottom in FIG. 12, the swivel has rotated relative to FIG. 11; in FIG. 12, only a portion of the post assembly is shown however it will be understood that the entire post assembly height follows the left post bottom and right post bottom due to the connection of the left post top to the left post bottom and the right post top to the right post bottom.

in FIG. 13, only a portion of the post assembly is shown however it will be understood that the entire post assembly height follows the left post bottom and right post bottom due to the connection of the left post top to the left post bottom and the right post top to the right post bottom.

in FIG. 14, the swivel has rotated relative to FIG. 13; in FIG. 14, only a portion of the post assembly is shown however it will be understood that the entire post assembly height follows the left post bottom and right post bottom due to the connection of the left post top to the left post bottom and the right post top to the right post bottom.

in FIG. 15, only a portion of the stand is shown.

in FIG. 16, only a portion of the stand is shown.

DETAILED DESCRIPTION

Figure 1:
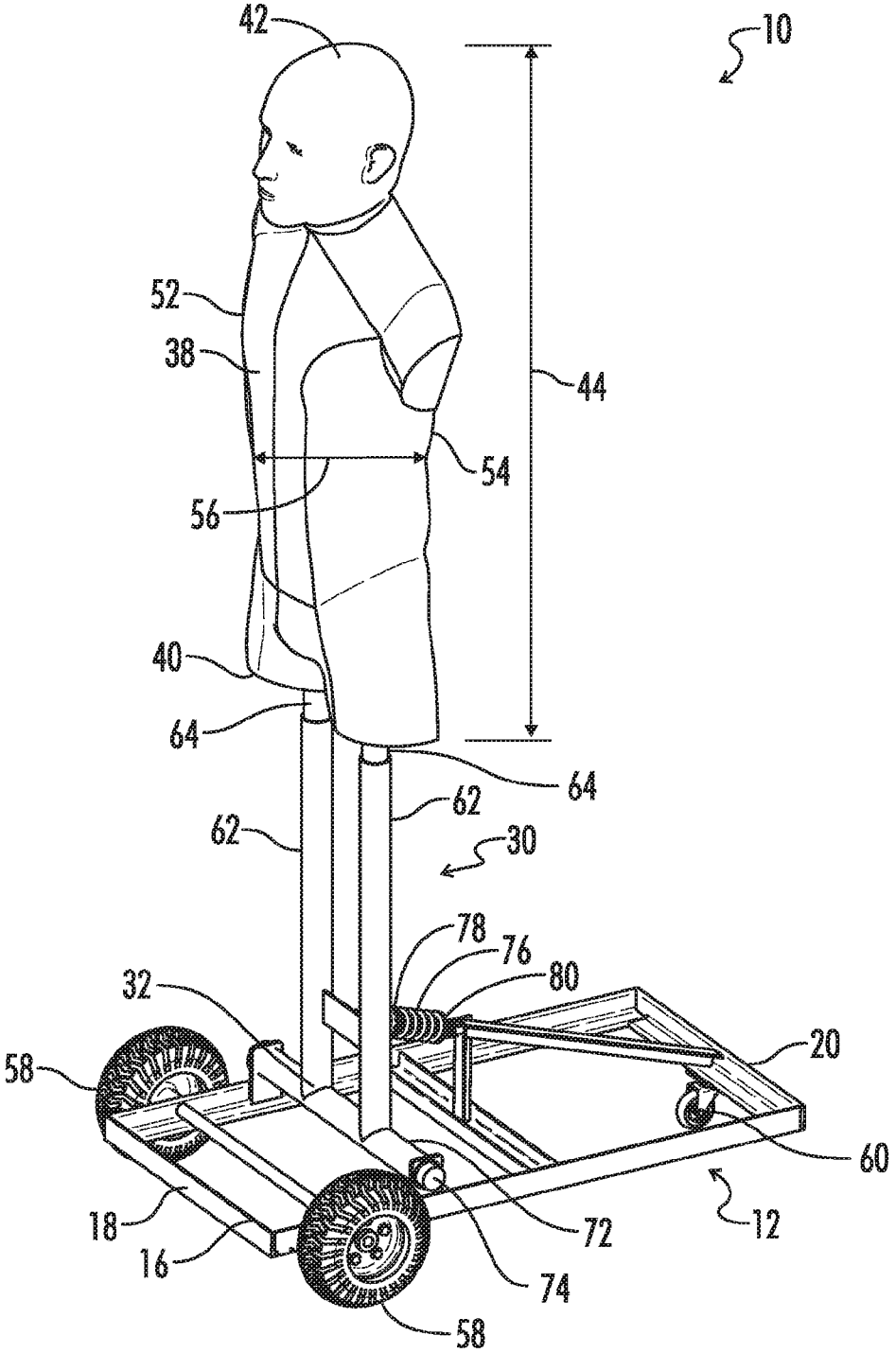
FIG. 1 illustrates a right side perspective view of a target of one embodiment of the present invention.
Figure 2:
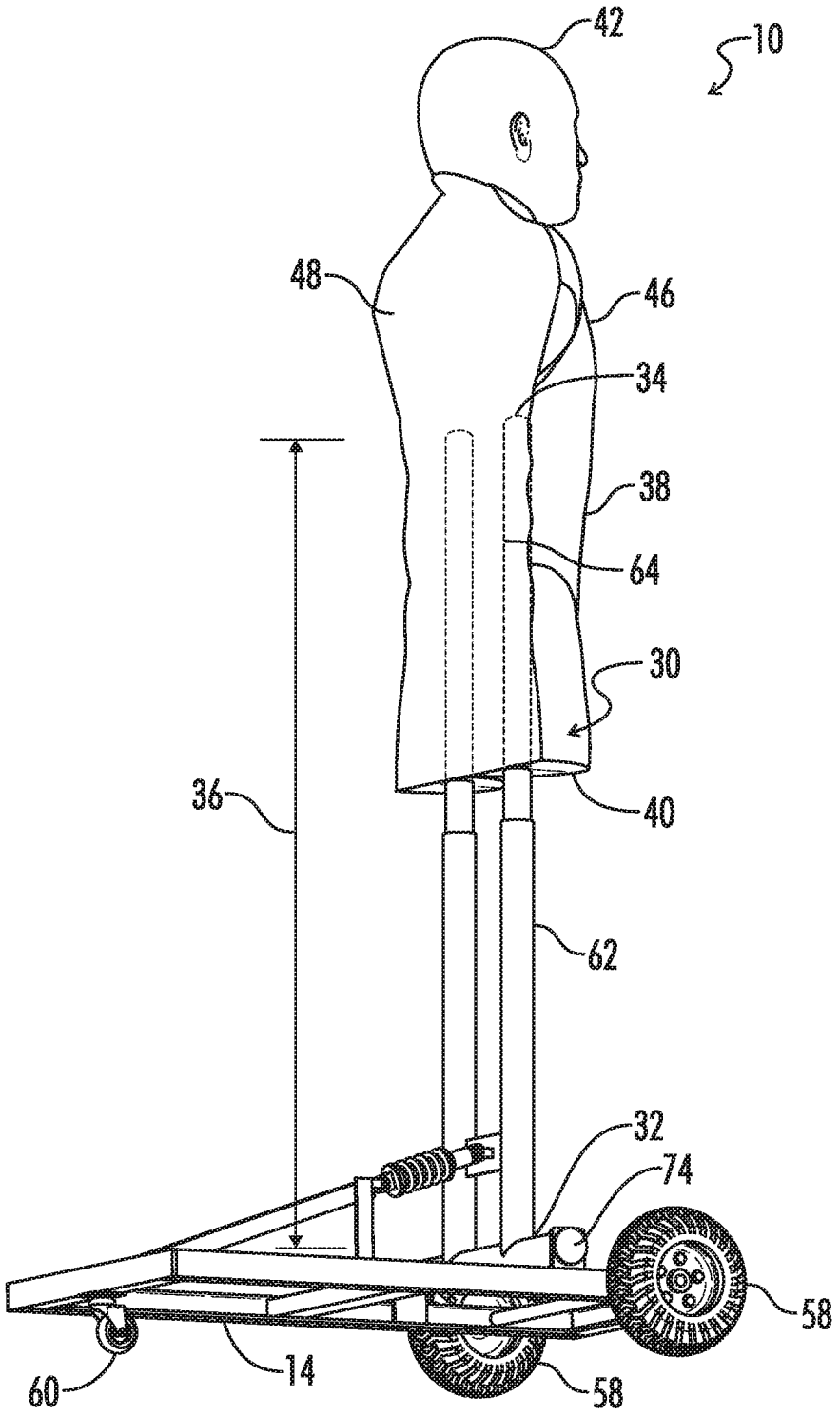
FIG. 2 illustrates a left side perspective view of the target of FIG. 1.
Figure 3:
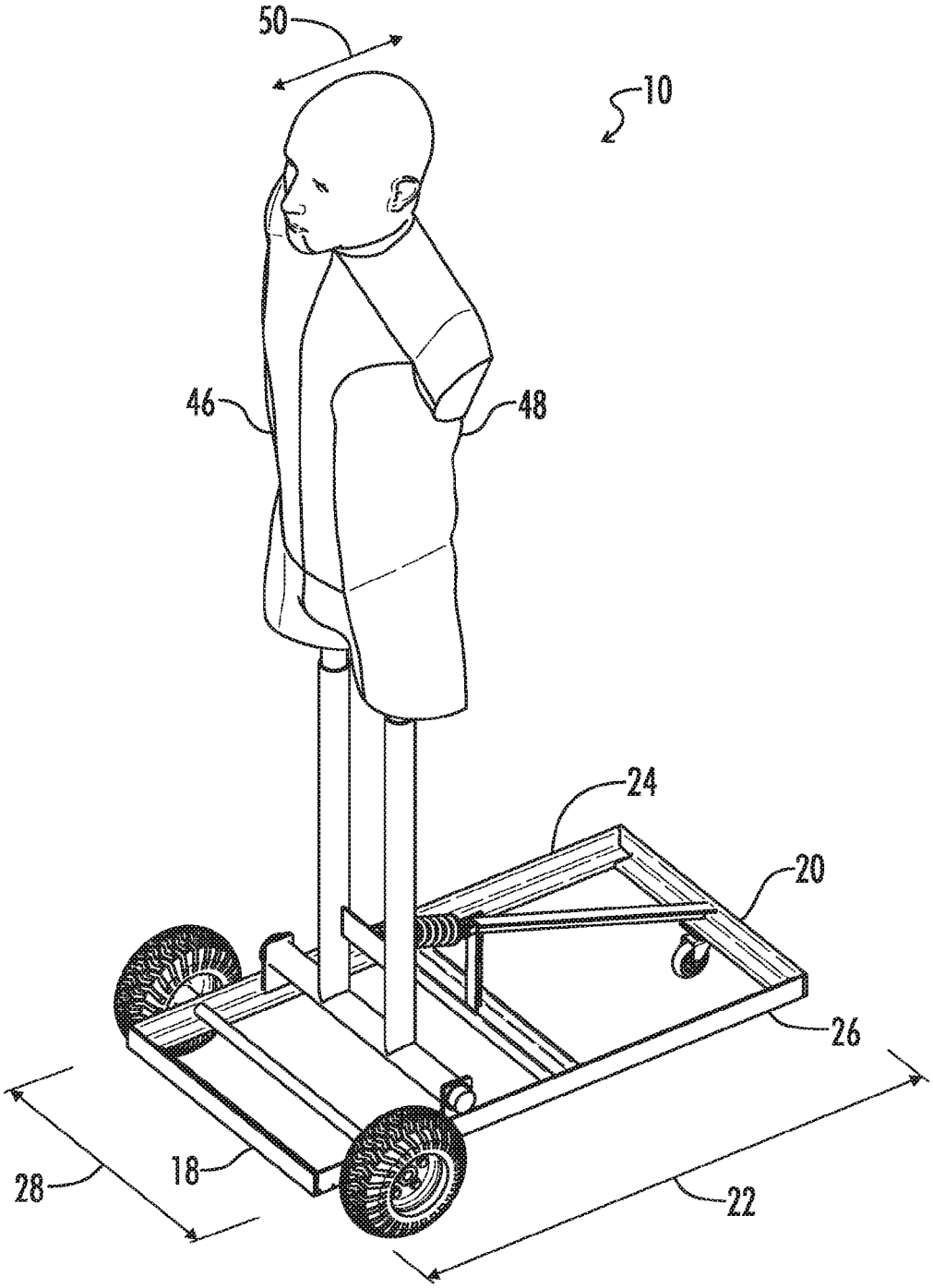
FIG. 3 illustrates another right side perspective view of the target of FIG. 1.
Figure 4:
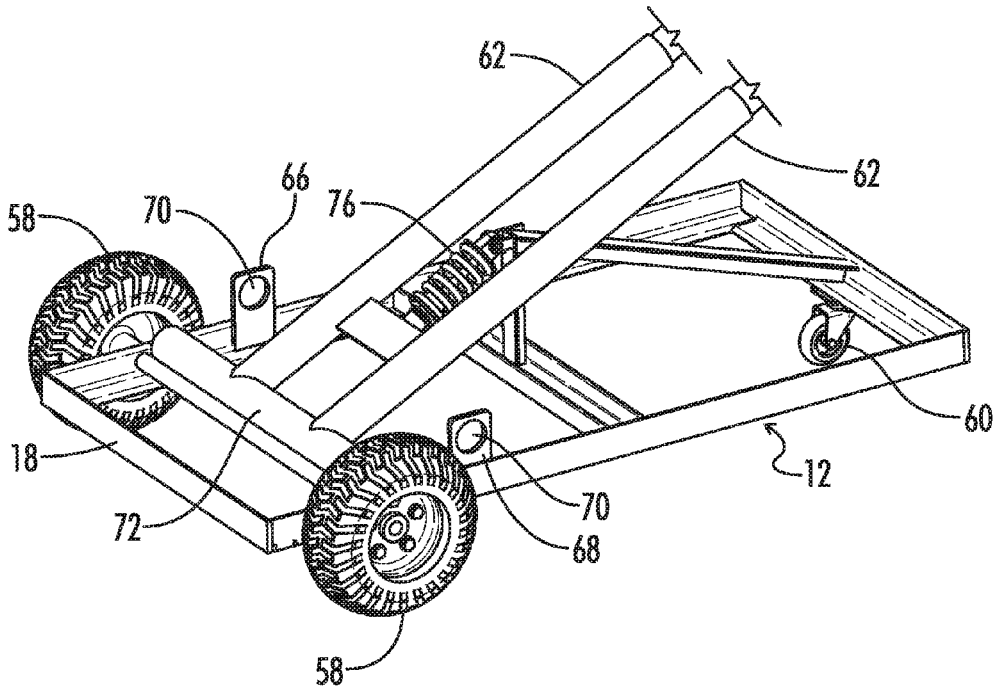
FIG. 4 illustrates a right side perspective view of the base and bottom posts of the target of FIG. 1.

With reference to FIGS. 1-7 the present disclosure provides a target generally designated by the numeral 10. In the drawings, not all reference numbers are included in each drawing for the sake of clarity.

Referring to FIGS. 1-7, in some embodiments, the present disclosure provides a target 10 that includes:

a) a base 12 comprising a bottom surface 14 configured to face the ground, a top surface 16 opposite the bottom surface 14, a forward end 18, a rear end 20, a base length 22 extending from the forward end 18 to the rear end 20, a left side 24, a right side 26, and a base width 28 extending from the left side 24 to the right side 26;

b) at least one post assembly 30 comprising a bottom end 32 connected to the base 12, a top end 34 and a height 36 extending from the bottom end 32 to the top end 34; and c) a target body 38 connected to the at least one post assembly 30 so that the at least one post assembly 30 extends at least partially through the target body 38, the target body 38 having a bottom end 40, a top end 42, a height 44 extending from the bottom end 40 to the top end 42, a front end 46, a rear end 48, a thickness 50 extending from the front end 46 to the rear end 48, a left side 52, a right side 54, and a width 56 extending from the left side 52 to the right side 54. Optionally, the target body 38 is connected to the top end 34 of the at least one post assembly 30. For example, the target body 38 may form around and enclose the top end 34 of the at least one post assembly 30 if a mold is used as described below.

Optionally, the target body 38 is comprised of a synthetic polyurethane. Optionally, the polyurethane comprises at least about 75% by weight of the target body 38. Optionally, the target body 38 has a durometer (Shore A) of from about 5 to about 45. Prototypes have been constructed as illustrated in FIGS. 1-6 by mixing either TYRFIL LD Prepolymer and TYRFIL LD Catalyst or TYRFIL MG-30 Prepolymer and TYRFIL MG-30 Catalyst (Pathway Polymers, Chattanooga Tenn.) in a humanoid mold, and letting the material cure pursuant to the manufacturer's instructions to form the target body 38. It has been found that a target body 38 prepared by mixing TYRFIL LD Prepolymer and TYRFIL LD Catalyst is particularly durable, as such a target body 38 has withstood approximately 3,000 total shots from a combination of different firearms (.22, 38, 9 mm. 10 mm., 45, 5.56, 0.223, 380, 30/30, 12 gauge slug and 9 pellet 00, and .308) and stayed intact. In addition, it has been found that a target body 38 prepared by mixing TYRFIL MG-30 Prepolymer and TYRFIL MG-30 Catalyst is particularly durable, as such a target body 38 has withstood approximately 1,000 rounds of ammunition and shown little signs of wear. It is preferred that a shooter shots no closer than four feet to the target body 38. Preferably, the target body 38 has physical and chemical characteristics very similar to the end product prepared by mixing either TYRFIL LD Prepolymer and TYRFIL LD Catalyst or TYRFIL MG-30 Prepolymer and TYRFIL MG-30 Catalyst (Pathway Polymers, Chattanooga Tenn.) and curing the mixture according to the manufacturer's instructions (e.g., a density within 5% of the density of TYRFIL LD or TYRFIL MG-30 final product).

TYRFIL is described in for example U.S. Pat. No. 3,866,652, the entire contents of which are incorporated herein by reference, where TYRFIL is described as the reaction product of (A) a polypropylene glycol having an average molecular weight in the range of about 1,800 to 2,400 and containing free hydroxyl functionality of about 0.9 to about 1.1 meg/gm of polypropylene glycol, and (B) a prepolymer of (1) an excess of a mixture of the 2,4 and 2,6 isomers of toluene diisocyanate and (2) said polypropylene glycol with the prepolymer containing free isocyanate functionality of about 0.9 to about 1.1 meg/gm of prepolymer. TYRFIL is also described in U.S. Pat. No. 4,285,854, the entire contents of which are incorporated herein by reference, where it is said TYRFIL is prepared from a polyester or polyether having a terminal hydroxyl group (hereinafter referred to as "—OH group") and a diisocyanate, that is, polyurethane having a polyether or polyester as the skeleton. According to U.S. Pat. No. 4,285,854, TYRFIL is said to be a reaction product of a mixture of polyoxypropylene glycol and polyoxypropylene triol with tolylene diisocyanate (TDI). Additional information concerning reaction mixtures of polyols and isocyanates is found in U.S. Pat. No. 7,066,724, the entire contents of which are incorporated herein by reference.

Optionally, the target body 38 is located closer to the base front 18 than the base rear 20. The target body 38 usually is solid and opaque and covers the tops of the post assemblies 30; however, in FIGS. 2 and 3, the post assemblies 30 are partially shown through the target body 38 for illustration purposes only.

Figure 5:
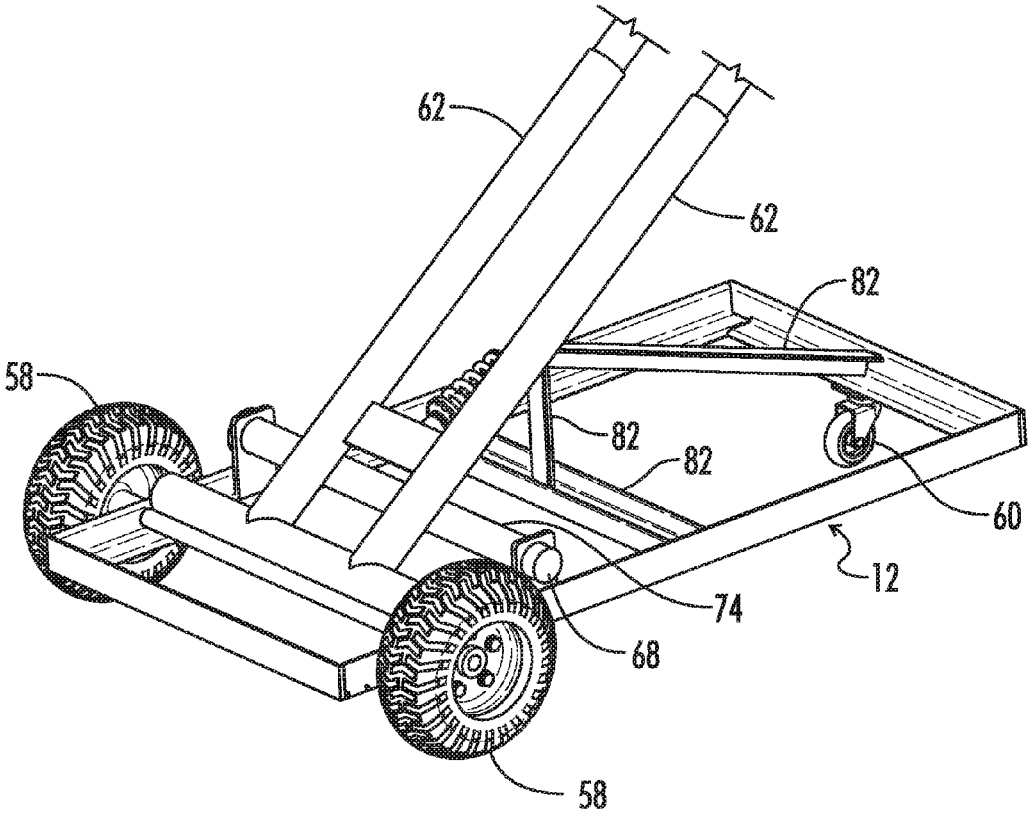
FIG. 5 illustrates a right side perspective view of the base and bottom posts of the target of FIG. 1.
Figure 6:
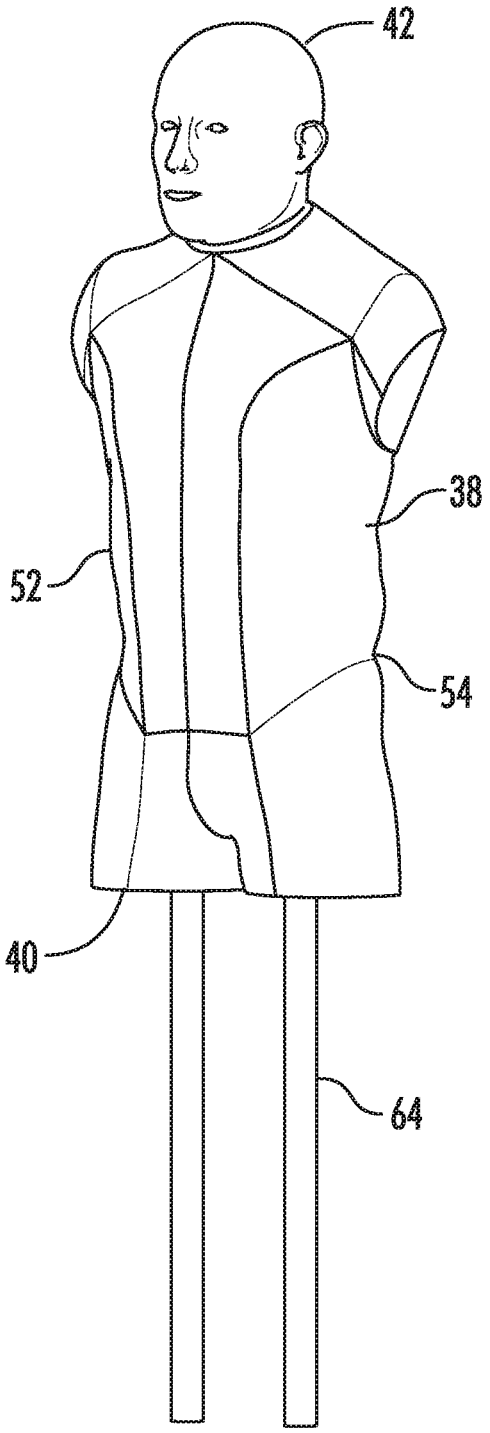
FIG. 6 illustrates a front elevation view of the target body and bottom post of the target of FIG. 1.
Figure 7:
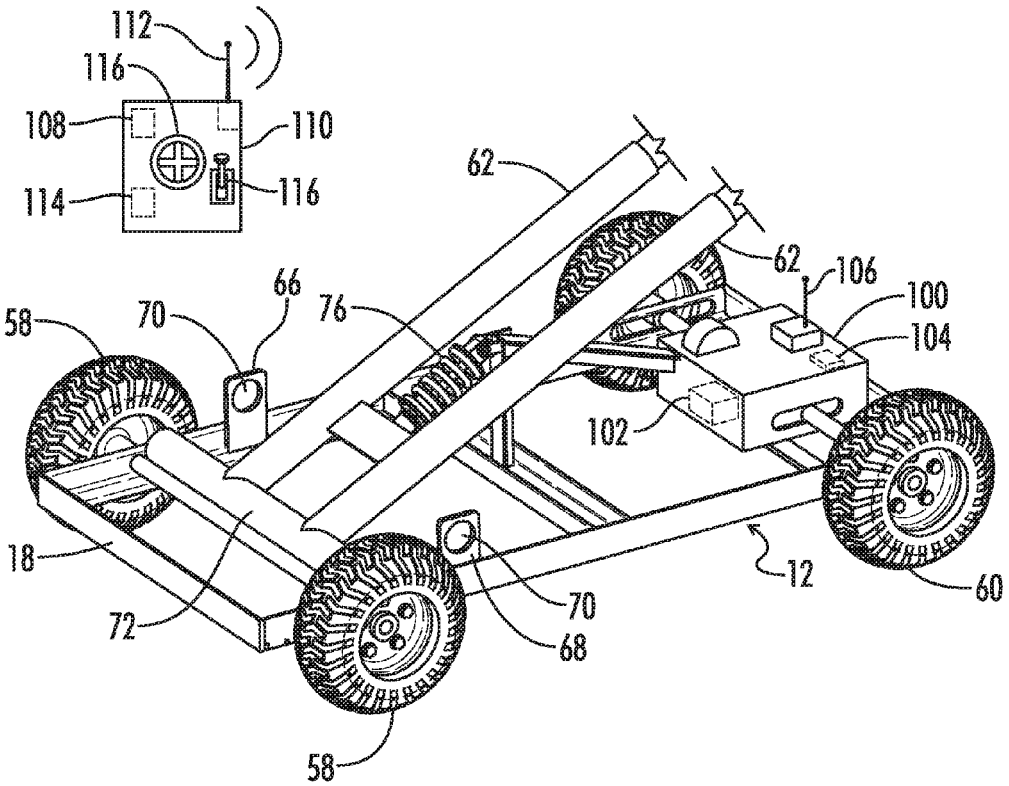
FIG. 7 illustrates a right side perspective view of a target base, bottom posts and remote control of another embodiment of the present invention.

Optionally, the target 10 includes at least one wheel attached to the base 12 and configured to move the base 12 along the ground. For example, the base 12 may include two regular wheels 58 (that rotate on an axis like a vehicle wheel) and one or two caster wheels 60. Optionally, the base 12 comprises two regular wheels 58 located adjacent to an end (18 or 20 of the base 12 and a caster wheel 60 adjacent to an opposite end (18 or 20) of the base 12, as shown in FIGS. 1-5, which is advantageous in that the target body 38 can be easily moved by tilting the target body 38 forwardly and placing all of the weight on the two regular wheels 58. Alternatively, the base 12 may comprise two regular wheels 58 located approximately in the lengthwise center of the base 12, a front caster wheel 60 adjacent to the front end 18 of the base 12, and a rear caster wheel 60 adjacent to the rear end 20 of the base 12. Alternatively, the base 12 may comprise four regular wheels 58, as shown in FIG. 7—i.e., two regular wheels 58 at the forward end 18 and two regular wheels 58 at the rear end 20. Optionally, as shown in FIG. 7, the base 12 further comprises a motor 100 configured to move the regular wheel(s) 58 and a power source 102 configured to power the motor 100. Optionally, the at least one post assembly 30 is generally cylindrical, as shown in FIGS. 1-7. Optionally, the target 10 comprises two post assemblies 30 (namely a left and right post assembly), each post assembly 30 comprising a bottom end 32 connected to the base 12, a top end 34 and a height 36 extending from the bottom end 32 to the top end 34. Optionally, each post assembly 30 extends between about 50% and about 125% (more preferably between about 50% and about 100%) of the height 44 of the target body 38. Optionally, each post assembly 30 is located approximately in the middle of the target body thickness 50. Optionally, the post assemblies 30 are generally the same height. Optionally, the target 10 has a height extending from the base 12 to the top 42 of the target body 38 of from about 3 feet to about 8 feet. Optionally, the target body 38 has a median thickness 50 of from about 8 inches to about 24 inches and a median width 56 of from about 12 inches to about 36 inches. Optionally, the target body 38 is generally in the shape of a body of an animal (e.g., humanoid or in the shape of a deer or another game). Each post assembly 30 may be a single post or formed by a plurality of posts. For example, each one post assembly 30 may comprise a bottom post 62 connected to the base 12 and a top post 64 connected to the target body 38 and further wherein the bottom post 62 comprises a hollow interior and the top post 64 is configured to partially nest in the bottom post 62 interior and move relative to the bottom post 62 and moving the top post 64 relative to the bottom post 62 is configured to change the height 44 of the target 12. (It will be understood that in order for the top post 64 to nest in the bottom post 62, the height of the top post 64 should be greater than the height of the bottom post 62). Optionally, the post assembly 30 comprises a pin aperture and pin so that the target height 44 can be adjusted like a basketball hoop. Optionally, the target 12 further comprises a motor configured to move the top post 64 relative to the bottom post 62 and a power source configured to power the motor. Optionally, the target 12 further comprises a left flange 66 extending generally upwardly from the base left side 24, a right flange 68 extending generally upwardly from the base right side 26, an aperture 70 located in each flange 66 and 68, a hollow horizontal bar 72 generally parallel to the target width 56 and the base width 28, the hollow horizontal bar 72 traversing the base 12, and the target 10 further includes a pin 74 configured to be removably inserted through the flange apertures 70 and through the hollow horizontal bar 72. Optionally, the target 10 comprises an expanded position (see FIGS. 1-3) in which the pin 74 is inserted through the flange apertures 70 and through the hollow horizontal bar 72 and in which the at least one post assembly 30 is generally perpendicular to the base 12 and further wherein the target 10 comprises a collapsed position (see FIGS. 4 and 5) in which the pin 74 is removed from the hollow horizontal bar 72 and in which the at least one post assembly 30 is at an angle of between about 0 degrees and about 45 degrees relative to the base 12. In FIG. 5, the pin 74 has been re-inserted through the flange apertures 70 but not through the hollow horizontal bar 72 for storage. As will be appreciated, the pin 74 and hollow horizontal bar 72 are generally cylindrical in shape with the outer diameter of the pin 74 for at least the majority of the length of the pin 74 being less than the inner diameter of the hollow horizontal bar 72 so that the pin 74 nests inside the horizontal bar 72, it being understood that the pin 74 may have an enlarged left or right end.

Optionally, the target 10 further comprises a shock/spring 76 having a forward end 78 connected to the at least one post assembly 30 and a rear end 80 connected to the base 12. The shock/spring 76 acts as a vertical stabilizer and to allow motion when the target body 38 is struck by a projectile. Optionally, the base 12 is generally rectangular in shape. Optionally, the target 10 may include plurality of braces 82.

Optionally, if the wheels 58 are motorized (e.g., by the wheel motor 100 rotating an axle), the base 12 further comprises a base microprocessor 104 configured to control the wheel motor 100 and a receiver 106. As mentioned above, a wheel power source 102 (e.g., a battery) powers the wheel motor 100. A remote control 110 may be used to control the wheel motor 100. More particularly, the remote control 110 may be in electronic communication with the remote control microprocessor 108 of the remote control 110. The remote control microprocessor 108 is configured to control the base microprocessor 104 and the wheel motor 100. More particularly, the remote control 110 may also include a transmitter 112 configured to transmit control signals from the remote control microprocessor 108 to the receiver 106. The remote control 110 may also include a remote control power source 114 (e.g., battery) configured to power the remote control microprocessor 108. The remote control 110 also includes one or more controls 116 (e.g., buttons). Optionally, the target 12 further comprises a second motor (not shown) configured to move the top post 64 relative to the bottom post 62 and a third power source (not shown) configured to power the second motor, and the remote control microprocessor is configured to control the second motor.

It has been observed that the target body 38 glows green when irradiated with only black light when the target body 38 is made of TYRFIL MG-30. It has also been observed that the target body 38 glows blue when irradiated with black light and white light.

Optionally, the target 10 is used in a method that includes: a) providing the target 10; and b) aiming a fighting implement towards the target 10 (more particularly toward target body 38). Optionally, the fighting implement is metallic. Optionally, the fighting implement is selected from the group consisting of a sword, a bow, and a bullet.

The targets 10 can be made by any suitable method. Optionally, the target 10 is prepared by a method that includes:

a) providing a mold in the shape of a body of an animal;

b) adding a polyol, an isocyanate (more preferably a diisocyanate) and a catalyst to the mold to form a mixture; and c) allowing the mixture to form a polyurethane in the shape of a body of an animal.

Optionally, the method further includes heating the mixture after step b). Optionally, the polyurethane in the shape of a body of an animal has a durometer Shore A of from about 5 to about 45. Optionally, the diisocyanate is tolylene diisocyanate. Optionally, the mold comprises a top end, a bottom end comprising at least one aperture, a height extending from the top end to the bottom end, a front end, a rear end, a thickness extending from the front end to the rear end, a left side, a right side, and a width extending from the left side to the right side, and further wherein the method further comprises inserting a post assembly 30 through the at least one aperture prior to or during step c). Optionally, the post assembly 30 is generally cylindrical in shape. Optionally, the post assembly 30 is inserted through the at least one aperture so that the post assembly 30 extends between about 50% and about 125% of the height of the mold (more preferably between about 50% and about 100% of the height of the mold). Optionally, the bottom end comprises two apertures and the method further comprises providing two post assemblies 30 and inserting a post assembly 30 through each aperture prior to or during step c). Optionally, the mold is generally hollow prior to step b). Optionally, the rear side is generally open prior to step b). Optionally, the method further includes connecting the post assembly 20 to a base 12.

While the targets 10 described herein have been described particularly as being useful with firearms, it will appreciated that the targets 10 may also be used to absorb swords and bows, for example, in sword and archery training.

The Embodiments of FIGS. 8-15

FIGS. 8-15 show a target 10 that is similar to the target 10 of FIGS. 1-7 but that further includes a swivel 120 that rotates about a swivel axis of rotation 122 that is generally parallel to the base height 118 and that also includes a post assembly 130 that tilts within a slot 128 toward the ground upon removal of a pin 158 or other fastener.

Figure 8:
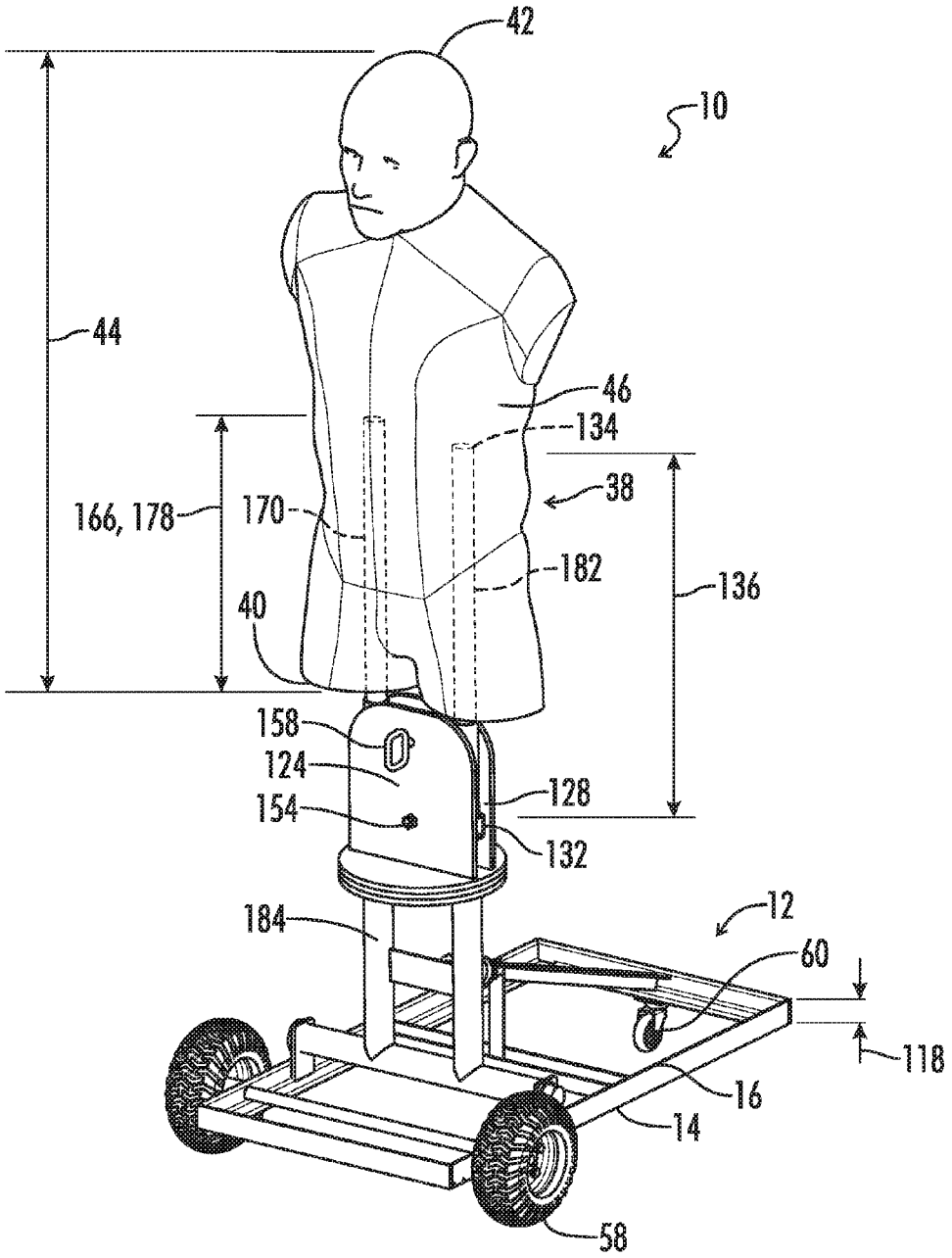
FIG. 8 illustrates a side perspective view of a target of another embodiment of the present invention.
Figure 9:
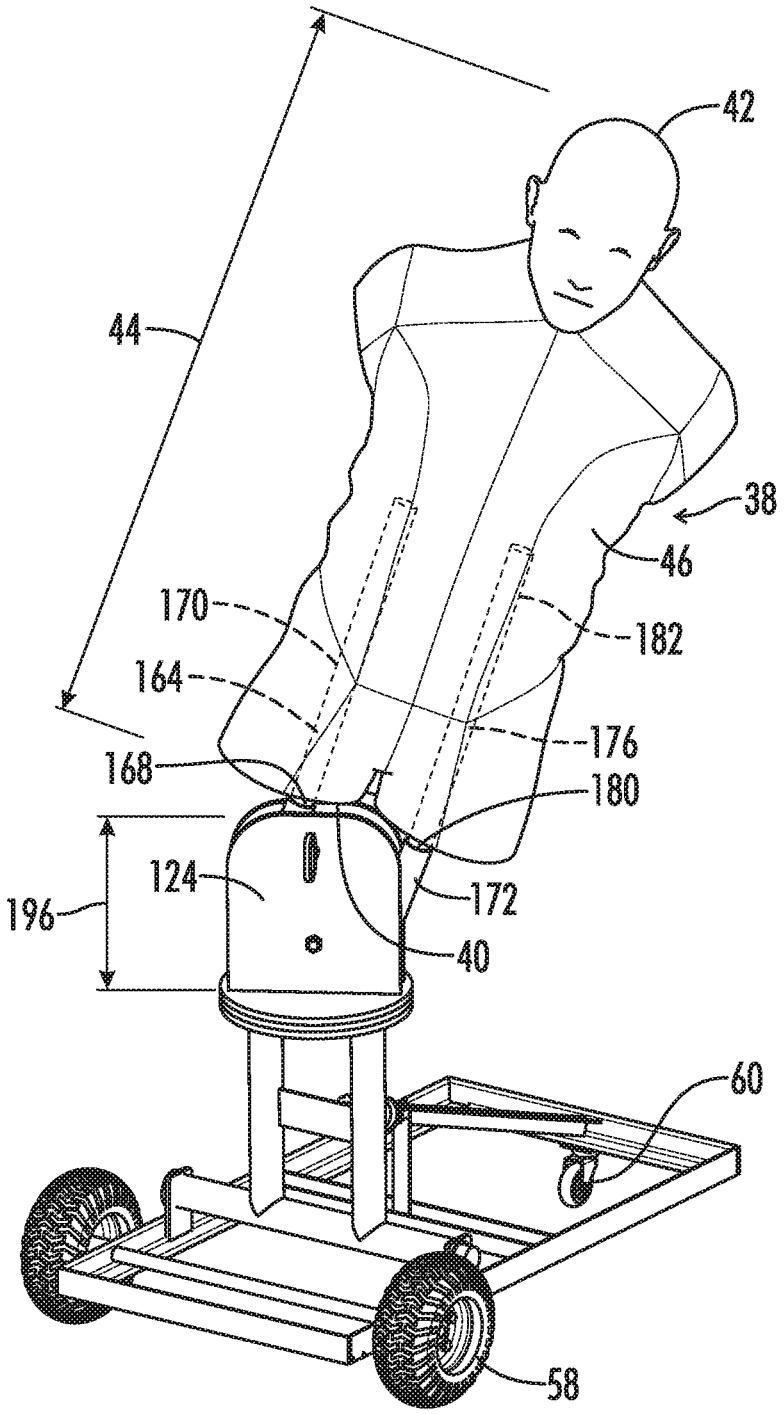
FIG. 9 illustrates a side perspective view of the target of FIG. 8.
Figure 10:
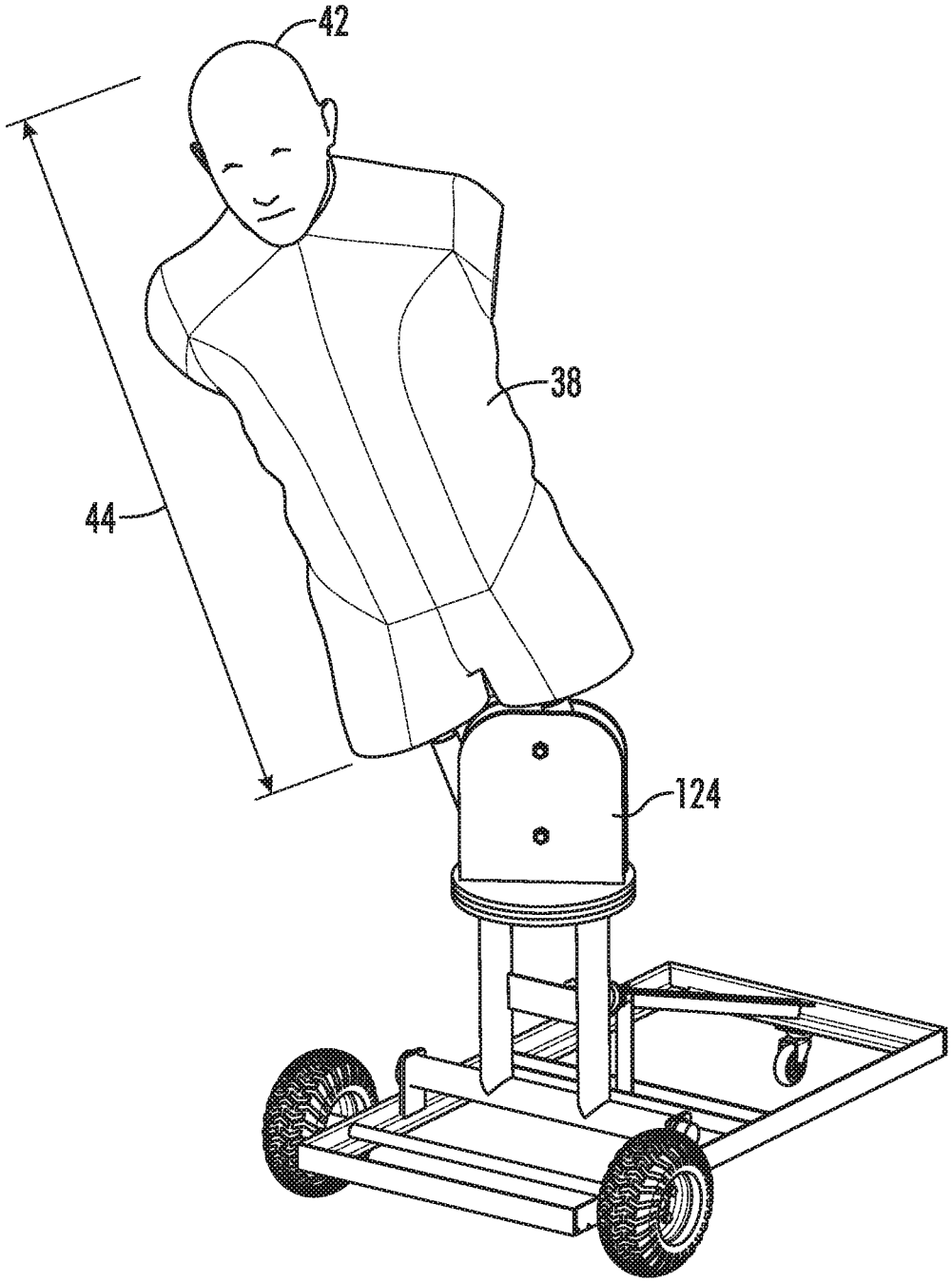
FIG. 10 illustrates a side perspective view of the target of FIG. 8.
Figure 11:
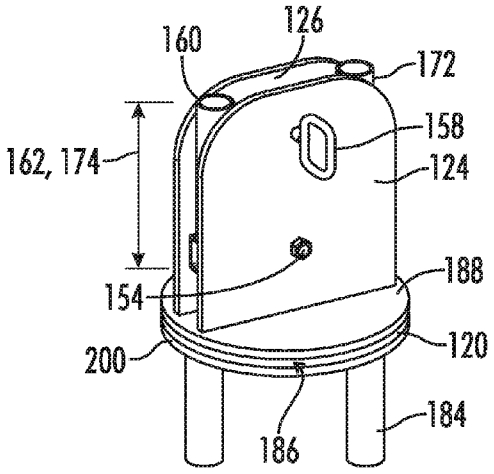
FIG. 11 illustrates a front perspective view of a lower portion of the post assembly and swivel of FIG. 8 with the post assembly in the upright position.
Figure 12:
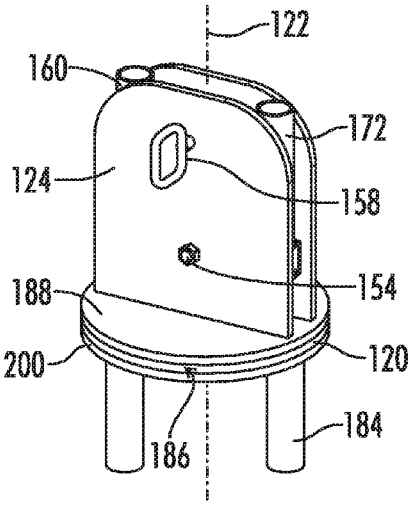
FIG. 12 illustrates a front perspective view of a lower portion of the post assembly and swivel of FIG. 8 with the post assembly in the upright position.
Figure 13:
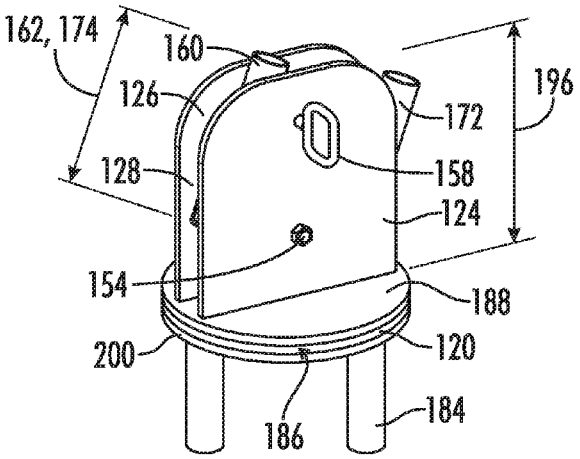
FIG. 13 illustrates a front perspective view of a lower portion of the post assembly and swivel of FIG. 8 with the post assembly in the tilted position.
Figure 14:
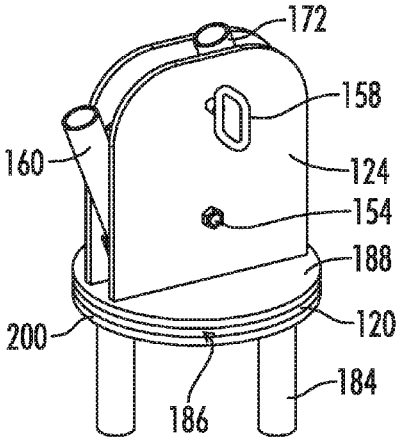
FIG. 14 illustrates a front perspective view of a lower portion of the post assembly and swivel of FIG. 8 with the post assembly in the tilted position.
Figure 15:
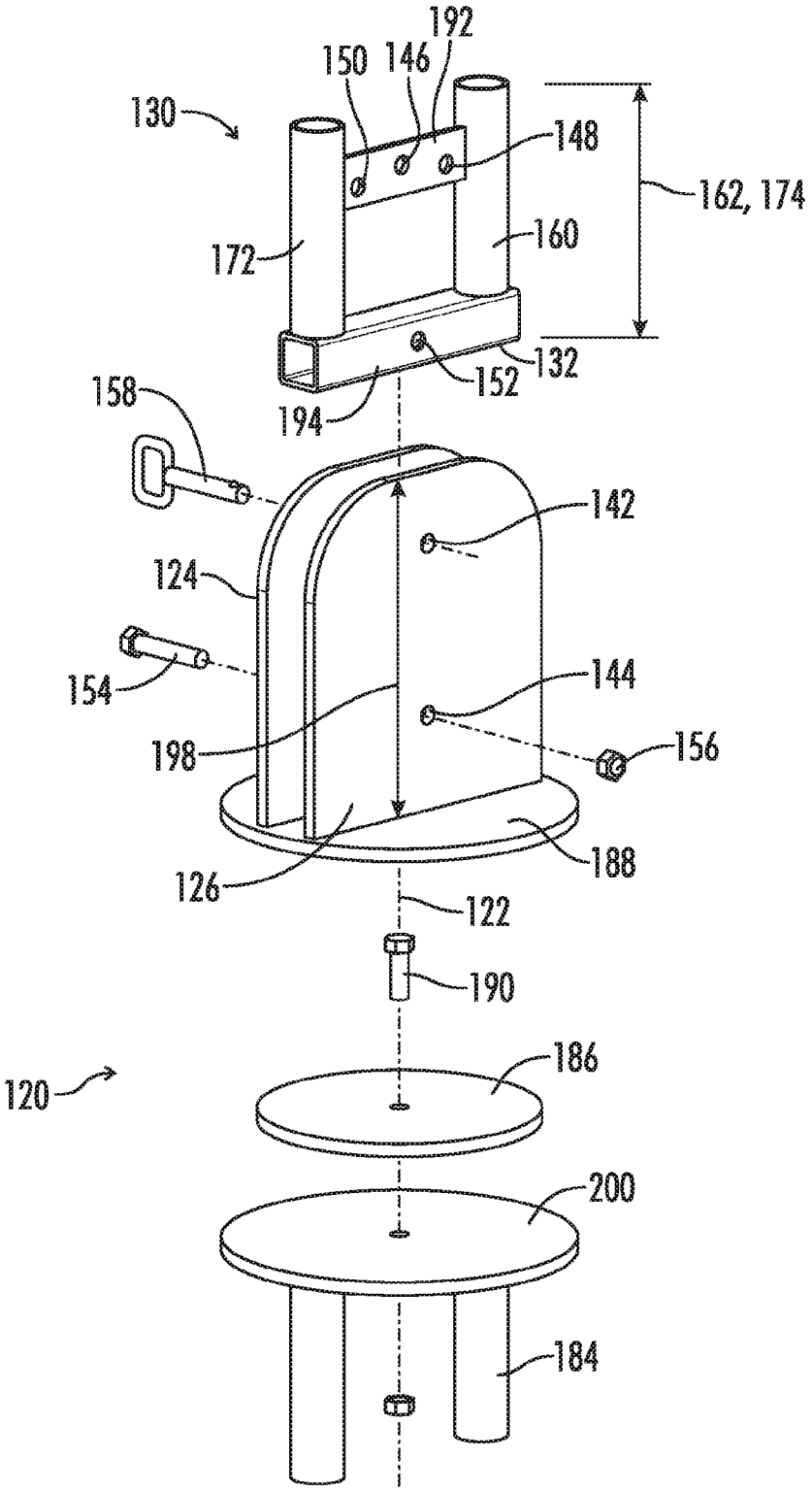
FIG. 15 illustrates a rear perspective exploded view of the lower portion of the post assembly and swivel of FIG. 8.

More particularly, with reference to FIGS. 8-15 the target 10 may include a base 12, which may include one or more features described above. It is noted that the base 12 includes a base height 118 extending from the base bottom surface 14 to the base top surface 16. The target 10 may further include at least one wheel (e.g., regular wheels 58 and/or castor wheels 60) extending downwardly from the base 12 and configured to move the base 12 along the ground. The target 10 may further include a rotatable swivel 120 connected to the base 12 and located above the base 12, the rotatable swivel 120 configured to rotate about a swivel axis 122 generally parallel to the base height 118. The target 10 may further include a front plate 124 and a rear plate 126 opposite the front plate 124, the front and rear plates 124 and 126 connected to the rotatable swivel 120 and located above the swivel 120, the front and rear plates 124 and 126 separated by a slot 128, which may be generally arc-shaped, the front plate 124 and the rear plate 126 having a height 196 and 198 generally parallel to the base height 118. The target 10 may further include a post assembly 130 comprising a post assembly bottom 132 seated inside the slot 128 and connected to the rotatable swivel 120, a post assembly top 134 and a post assembly height 136 extending from the post assembly bottom 132 to the post assembly top 134. The target 10 may further include a target body 38 connected to the at least one post assembly 130. The target body 38 may include one or more features described with respect to FIGS. 1-7. In FIGS. 8-15, the post assembly 130 is configured to tilt along an arc in a plane generally parallel to the front plate 124 and rear plate 126 within the slot 128 from an upright position in which the post assembly height 136 and the target body height 44 are generally parallel to the base height 118 (as shown in FIG. 8 for example) to an tilted position (as shown in FIGS. 9 and 10 for example) in which the target body 38 moves downwardly toward the ground and in which the post assembly height 136 and the target body height 44 are at least angled about 10 degrees (preferably at least about 20 degrees, more preferably at least about 30 degrees) relative to the base height 118 and the front plate height 196. In other words, the target body 38 may be moved from the upright position along an arc-shaped pivot so that the target body 38 tilts toward the ground, which may be preferred in some environments of use, such as allowing the target body 38 to peer around a corner. Preferably, the target body 38 is able to tilt downwardly to the left (as shown in FIG. 10) and to the right (as shown in FIG. 9). However, in other embodiments, the target body 38 may only tilt in one direction for example.

Preferably, the target body 38 and the post assembly 130 are also configured to rotate with the rotatable swivel 120 about the swivel axis 122 of rotation. Rotation about the swivel axis 122 of rotation is shown in FIGS. 11-14, where the left top post 164 and the right top post 176 of the post assembly 130 is not shown for ease of illustration.

Optionally, the front plate 124 and the rear plate 126 each comprise a top fastener hole and a bottom fastener hole (only the top fastener hole 142 and bottom fastener hole 144 of the rear plate 126 are shown in the views illustrated). The top fastener hole of the front plate 124 is preferably aligned with the top fastener hole 142 of the rear plate 126, and the bottom fastener hole of the front plate 124 is aligned with the bottom fastener hole 144 of the rear plate 126. In the embodiments of FIGS. 8-15, the post assembly 130 comprises a bottom fastener hole 152 aligned with the front plate bottom fastener hole and rear plate bottom fastener holes 144, and a bottom fastener (bolt) 154 extends through the front plate bottom fastener hole, the post assembly bottom fastener hole 152 and then through the rear plate bottom fastener hole 144 when the post assembly 130 is in the upright position and the tilted position. The bolt 154 is shown secured with a nut 156. In FIGS. 8-15, the post assembly 130 comprises a top fastener hole 146 that is located directly above the post assembly bottom fastener hole 152 when the post assembly 130 is in the upright position, and the post assembly 130 further comprises a left intermediate fastener hole 148 located laterally to the left of the top fastener hole 146 and slightly below the top fastener hole 146 when the post assembly 130 is in the upright position and a right intermediate fastener hole 150 located laterally to the right of the top fastener hole 146 and slightly below the top fastener hole 146 when the post assembly 130 is in the upright position. Optionally, a top fastener 158 (e.g., a removable pin) extends through the front plate top fastener hole, the post assembly top fastener hole 146 and then through the rear plate top fastener hole 142 when the post assembly 130 is in the upright position. Conversely, when the post assembly 130 is in the right tilted position (FIG. 9), the top fastener 158 extends through the front plate top fastener hole, the post assembly right intermediate fastener hole 150 and then the through the rear plate top fastener hole 142. And when the post assembly 130 is in the left tilted position (FIG. 10), the top fastener 158 extends through the front plate top fastener hole, the post assembly left intermediate fastener hole 148 and then the through the rear plate top fastener hole 142. By contrast, the bottom fastener (bolt) 154 preferably extends through the front plate bottom fastener hole, the post assembly bottom fastener hole 152 and then through the rear plate bottom fastener hole 144 when the post assembly 130 is in the upright position and the tilted position so that the post assembly 130 pivots around the bottom fastener 154 when moving from the upright position to the tilted/angled position Optionally, the top fastener 158 is in the form of a removable pin, similar to for example a pin that is used in a piece of exercise equipment and removably located below one or more predetermined weights. In FIGS. 8-15, the top fastener 158 and the bottom fastener 154 extend through the front plate 124, the post assembly 30 and the rear plate 126 generally perpendicular to the swivel axis 122 of rotation.

Optionally, the post assembly 130 comprises left and right bottom posts 160 and 172, the left and right bottom posts 160 and 172 having left and right bottom post height 162 and 174 extending generally parallel to the target body height 44. In the embodiments of FIGS. 8-15, the post assembly 130 further comprises a lower horizontal post 194 extending generally perpendicular to the post assembly height 136 from the left bottom post 160 to the right bottom post 172 and comprising the bottom post assembly fastener hole 152, and the post assembly 130 further comprises an upper horizontal post 192 extending generally perpendicular to the post assembly height 136 from the left bottom post 160 to the right bottom post 172, above the lower horizontal post 194 and comprising the top fastener hole 146 and intermediate left and right fastener holes 148 and 150. Optionally, the post assembly 130 further comprises a left top post 164 having a lower portion 168 connected to the left bottom post 160 and an upper portion 170 connected to the target body 38 and further wherein the post assembly 130 further comprises a right top post 176 having a lower portion 180 connected to the right bottom post 172 and an upper portion 182 connected to the target body 38, the left top post 164 and the right top post 176 generally parallel to the target body height 44.

Optionally, the swivel 120 is configured to rotate 360 degrees about the swivel axis 122.

In FIGS. 8-15, the target 10 further includes a stand 184 connected to the base 12, and the swivel 120 is comprised of a bushing 186 and a top plate/disk 188 connected to and located below the front and rear plates 124 and 126. The stand 184 further includes a bottom plate/disk 200 located directly below the bushing 186 that serves to separate the bottom plate/disk 200 from the top plate/disk 188 and allow for less frictional interference in rotation of top plate/disk 188 relative to bottom plate/disk 200. In an exemplary embodiment, the bushing 186 has a diameter of about five inches for example and an open center portion. Optionally, the target 10 further includes a spindle 190 connecting the top/plate disk 188 to the bushing 186 and the bottom plate/disk 200 and forming the swivel axis 122 of rotation and the bushing fastener/spindle 190 may be oriented generally parallel to the height of the front plate height 196, rear plate height 198 and the base height 118. Preferably, in both the upright and tilted position, the target body 38 is located above the base 12. Instead of a bushing 186, the swivel 120 may utilize a bearing. It will be understood that the top plate/disk 188 may be directly attached to, or otherwise integral with, the front plate 124 and rear plate 126 as shown in FIGS. 8-15.

The target 10 may be used for any suitable purpose. For example, in an exemplary embodiment, the target 10 is used in a method of using a target 10 comprising the steps of; a) providing the target 10; and b) aiming a fighting implement towards the target 10. Optionally, the fighting implement is metallic. Optionally, the fighting implement is selected from the group consisting of a sword, a bow, and a bullet.

Figure 16:
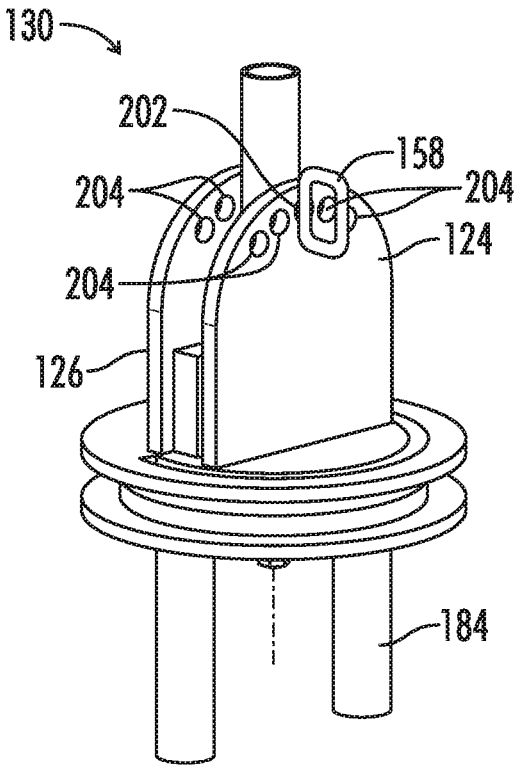
FIG. 16 illustrates a rear perspective exploded view of the lower portion of a post assembly and swivel of another embodiment of a target of the present invention.

The Embodiment of FIG. 16

FIG. 16 illustrates an alternate embodiment to FIGS. 8-15 in which the post assembly 130 tilts within the slot 128 and similarly includes the swivel 120, swivel axis 122, top plate/disk 188, bushing 186 and bottom plate/disk 200. FIG. 16 differs from the embodiment of FIGS. 8-15 in that FIG. 16 includes only one bottom post and top post in the post assembly 130 and the front and rear plate includes a top fastener hole 202 that receives the pin 158 when the post assembly 130 is in the upright position and multiple lower lateral fastener holes 204 that receive the pin 158 when the post assembly 130 is in the titled/angled position.

| Part List | |
|---|---|
| target | 10 |
| base | 12 |
| base bottom surface | 14 |
| base top surface | 16 |
| base forward end | 18 |
| base rear end | 20 |
| base length | 22 |
| base left side | 24 |
| base right side | 26 |
| base width | 28 |
| post assembly | 30 |
| post assembly bottom | 32 |
| post assembly top | 34 |
| post assembly height | 36 |
| target body | 38 |
| target bottom end | 40 |
| target top end | 42 |
| target height | 44 |
| target front end | 46 |
| target rear end | 48 |
| target thickness | 50 |
| target left side | 52 |
| target right side | 54 |
| target width | 56 |
| regular wheel | 58 |
| caster wheel | 60 |
| bottom post | 62 |
| top post | 64 |
| base left flange | 66 |
| base right flange | 68 |
| flange apertures | 70 |
| horizontal bar | 72 |
| pin | 74 |
| spring | 76 |
| spring first forward end | 78 |
| spring rear end | 80 |
| braces | 82 |
| Motor | 100 |

-continued

| Part List | |
|---|---|
| power source | 102 |
| microprocessor | 104 |
| receiver | 106 |
| remote CPU | 108 |
| remote | 110 |
| transmitter | 112 |
| battery | 114 |
| control | 116 |
| base height | 118 |
| swivel | 120 |
| swivel axis | 122 |
| front plate | 124 |
| rear plate | 126 |
| slot | 128 |
| post assembly of FIGS. 8-15 | 130 |
| post assembly bottom | 132 |
| post assembly top | 134 |
| post assembly height | 136 |
| front plate top fastener hole | Hidden from view |
| front plate bottom fastener hole | Hidden from view |
| rear plate top fastener hole | 142 |
| rear plate bottom fastener hole | 144 |
| post assembly top most fastener hole | 146 |
| post assembly left intermediate fastener hole | 148 |
| post assembly right intermediate fastener hole | 150 |
| post assembly bottom fastener hole | 152 |
| bottom bolt | 154 |
| bottom nut | 156 |
| top pin | 158 |
| left bottom post | 160 |
| left bottom post height | 162 |
| left top post | 164 |
| left top post height | 166 |
| left top post lower portion | 168 |
| left top post upper portion | 170 |
| right bottom post | 172 |
| right bottom post height | 174 |
| right top post | 176 |
| right top post height | 178 |
| right top post lower portion | 180 |
| right top post upper portion | 182 |
| stand | 184 |
| bushing | 186 |
| Top plate/disk | 188 |
| bushing fastener/spindle | 190 |
| upper horizontal post | 192 |
| lower horizontal post | 194 |
| front plate height | 196 |
| rear plate height | 198 |
| Bottom plate/disk | 200 |
| Top plate hole of FIG. 16 | 202 |
| Lateral plate hole of FIG. 16 | 204 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A target comprising:

a) a base comprising a bottom surface configured to face the ground, a top surface opposite the bottom surface, a base height extending from the bottom surface to the top surface, a forward end, a rear end, a base length extending from the forward end to the rear end and generally perpendicular to the base height, a left side, a right side, and a base width extending from the left side to the right side and generally perpendicular to the base height and base length;

b) at least one wheel extending downwardly from the base and configured to move the base along the ground;

c) a rotatable swivel connected to the base and located above the base, the rotatable swivel configured to rotate about a swivel axis generally parallel to the base height;

d) a front plate and a rear plate opposite the front plate, the front and rear plates connected to the rotatable swivel and located above the swivel, the front and rear plates separated by a generally arc-shaped slot, the front plate and the rear plate having a height generally parallel to the base height;

e) a post assembly comprising a post assembly bottom seated inside the slot and connected to the rotatable swivel, a post assembly top and a post assembly height extending from the post assembly bottom to the post assembly top; and f) a target body connected to the post assembly, the target body having a bottom end, a top end, a height extending from the bottom end to the top end, a front end, a target body height extending from the top end to the bottom end, a rear end, a thickness extending from the front end to the rear end, a left side, a right side, and a width extending from the left side to the right side, wherein the post assembly extends at least partially through the target body, wherein the post assembly is configured to tilt along an arc in a plane generally parallel to the front plate and rear plate within the slot from an upright position in which the post assembly height and the target body height are generally parallel to the base height to a tilted position in which the target body moves downwardly toward the ground and in which the post assembly height and the target body height are at least angled about 10 degrees relative to the base height and the front plate height, and further wherein the target body and the post assembly are configured to rotate with the rotatable swivel about the swivel axis of rotation.

2. The target of claim 1, wherein the front plate and the rear plate each comprise at least one aligned fastener hole and the post assembly comprises a first fastener hole and a second fastener hole, and further wherein inserting a fastener through the front plate and rear plate fastener holes and the first fastener hole of the post assembly is configured to secure the post assembly in the upright position and further wherein inserting a fastener through the front plate and rear plate fastener holes and the second fastener hole of the post assembly is configured to secure the post assembly in the tilted position.

3. The target of claim 1 wherein the front plate and the rear plate each comprise a top fastener hole and a bottom fastener hole, wherein the top fastener hole of the front plate is aligned with the top fastener hole of the rear plate, wherein the bottom fastener hole of the front plate is aligned with the bottom fastener hole of the rear plate, wherein the post assembly comprises a bottom fastener hole aligned with the front plate and rear plate fastener holes, wherein a bottom fastener extends through the front plate bottom fastener hole, the post assembly bottom fastener hole and then through the rear plate bottom fastener hole when the post assembly is in the upright position and the tilted position, wherein the post assembly comprises a top fastener hole that is located directly above the post assembly bottom fastener hole when the post assembly is in the upright position, wherein the post assembly further comprises at least one intermediate fastener hole located laterally to the top fastener hole and below the top fastener hole when the post assembly is in the upright position, wherein a top fastener removably extends through the front plate top fastener hole, the post assembly top fastener hole and then through the rear plate top fastener hole when the post assembly is in the upright position, and further wherein the top fastener extends through the front plate top fastener hole, the post assembly intermediate fastener hole and then the through the rear plate top fastener hole when the post assembly is in the tilted position.

4. The target of claim 3 wherein the top fastener is in the form of a removable pin.

5. The target of claim 3 wherein the top fastener and the bottom fastener extend through the front plate, the post assembly and the rear plate generally perpendicular to the swivel axis of rotation.

6. The target of claim 3 wherein the post assembly comprises left and right bottom posts, the left and right bottom posts having a left and right bottom post height extending generally parallel to the target body height, wherein the post assembly further comprises a lower horizontal post extending generally perpendicular to the post assembly height from the left post to the right post and comprising the bottom post assembly fastener hole, and further wherein the post assembly further comprises an upper horizontal post extending generally perpendicular to the post assembly height from the left post to the right post, above the lower horizontal post and comprising the post assembly top fastener hole and at least one intermediate fastener hole.

7. The target of claim 6 wherein the post assembly further comprises a left top post having a lower portion connected to the left bottom post and an upper portion connected to the target body and further wherein the post assembly further comprises a right top post having a lower portion connected to the right bottom post and an upper portion connected to the target body, the left top post and the right top post generally parallel to the target body height.

8. The target of claim 1 wherein the swivel is configured to rotate 360 degrees about the swivel axis.

9. The target of claim 1 wherein the swivel is comprised of a bushing and a top plate located above the bushing and connected to and located below the front and rear plates, and further wherein the target comprises a stand connected to and extending generally upwardly from the base, the stand comprising a bottom plate located below the bushing, and further wherein the bushing separates the top plate from the bottom plate and allows for rotation of the top plate relative to the bottom plate around the swivel axis.

10. The target of claim 9 further comprising a spindle connecting the top plate to the bushing and to the bottom plate.

11. The target of claim 1 wherein, in the upright position and the tilted position, the target body is located above the base.

12. A method of using a target comprising the steps of;

a) providing the target of claim 1; and b) aiming a fighting implement towards the target of claim 1.

13. The method of claim 12 wherein the fighting implement is metallic.

14. The method of claim 12, wherein the fighting implement is selected from the group consisting of a sword, a bow, and a bullet.

15. The target of claim 1 wherein the front plate comprises a front plate top fastener hole and a plurality of lower fastener holes located laterally relative to and below the front plate top fastener hole, wherein the rear plate comprises a rear plate top fastener hole and a plurality of lower fastener holes located laterally relative to and below the rear plate top fastener hole, wherein the fastener holes of the front plate are aligned with the fastener holes of the rear plate, wherein a fastener removably extends through the top fastener holes of the front and rear plates when the post assembly is in the upright position and further wherein a fastener removably extends through a lower fastener hole of the front plate and a lower fastener hole of the rear plate when the post assembly is in the tilted position.

16. The target of claim 15 wherein the top and lower fastener holes of the front and rear plate are arranged in an arc-shaped pattern.

* * * * *